United States Patent [19]

Freerks

[11] Patent Number: 4,484,419

[45] Date of Patent: Nov. 27, 1984

[54] BLOCK FOR WET ABRADING

[75] Inventor: Conrad T. Freerks, Maplewood

[73] Assignee: Minnesota Mining and Manufacturing Company, Saint Paul, Minn.

[21] Appl. No.: 309,253

[22] Filed: Oct. 7, 1981

[51] Int. Cl.[3] ..... B24D 15/00

[52] U.S. Cl. ..... 51/391; 51/267

[58] Field of Search ..... 51/358, 213, 391, 392, 51/393, 267; 401/198, 199, 207

[56] References Cited

U.S. PATENT DOCUMENTS

| | | | |
|---|---|---|---|
| 1,347,091 | 7/1920 | Hamlin | 51/392 X |
| 1,898,170 | 2/1933 | Brown | 51/213 |
| 2,009,222 | 7/1935 | Connor | 51/213 |
| 2,417,356 | 3/1947 | Field | 51/391 |
| 2,665,528 | 1/1954 | Sternfield et al. | 51/402 |
| 2,802,317 | 8/1957 | Stuck | 51/213 |
| 2,904,940 | 9/1959 | Brown | 51/213 |
| 2,923,019 | 2/1960 | Rabe | 51/213 |
| 2,954,649 | 10/1960 | Carroll et al. | 51/187 |
| 3,527,001 | 9/1970 | Kleemeier | 51/358 |
| 3,892,091 | 7/1975 | Hutchins | 51/358 X |
| 4,102,084 | 7/1978 | Bloomquist | 51/134.5 |
| 4,121,386 | 10/1978 | Perez | 51/392 |
| 4,129,966 | 12/1978 | Smart et al. | 51/134.5 |
| 4,175,359 | 11/1979 | Teague et al. | 51/134.5 |
| 4,320,601 | 3/1982 | Haney | 51/391 |

FOREIGN PATENT DOCUMENTS

| | | | |
|---|---|---|---|
| 8280 | of 1903 | United Kingdom | 51/392 |
| 2075384 | 11/1981 | United Kingdom | 51/392 |

*Primary Examiner*—Frederick R. Schmidt

*Assistant Examiner*—Steven P. Schad

*Attorney, Agent, or Firm*—Donald M. Sell; James A. Smith; Richard Francis

[57] ABSTRACT

An abrading block (10) especially suited for wet hand surface finishing operations is provided. The abrading block (10) comprises a body (11) having a bottom surface (12) having an opening (13) therein. Bottom surface (12) is adapted to hold a sheet of abrasive material (14), also having an opening (15) therethrough, in a substantially planar position with an abrasive working face (16) exposed and with the opening (15) through the sheet of abrasive material (14) aligned with the opening (13) in the bottom surface (12). The body (11) also includes an opposite surface (17) capable of being grasped by the hand of the user, a cavity (18) capable of containing liquid, and a conduit (19) extending from the opening (13) in the bottom surface (12) to the cavity (18) for passage of liquid from the cavity (18) to the opening (13). An air vent (20) may be provided through the body (11) into the cavity (18) to permit liquid to flow therefrom under gravity. The abrading block (10) also includes a porous member (21) having a first portion (22) fitted into the conduit (19) to substantially prevent the free flow of liquid from the cavity (18) and an exposed wiping end portion (23) extending from the opening (13) to or beyond the abrasive working face (16). The porous member (21) is formed of a material which will permit the controlled passage of liquid as its exposed wiping end portion (23) is brought into contact with and passed over the surface (24) being finished during an abrading operation in a sufficient quantity to wet at least a portion of the surface (24) with liquid. Opposite surface (17) may include a handle (25).

5 Claims, 3 Drawing Figures

BLOCK FOR WET ABRADING

TECHNICAL FIELD

This invention relates to a manually operated abrading tool having a means of dispensing liquid onto a surface being finished during an abrading operation.

BACKGROUND ART

Manually operated abrading tools sometimes called abrading or sanding blocks have been utilized for a considerable period of time to prepare various surfaces, e.g., prior to application of paint. Such abrading blocks typically consist of a body adapted to hold a sheet of abrasive material with its exposed abrasive working face in a planar configuration. Such abrading blocks are commonly used for preparation of motor vehicle bodies for refinishing.

Most abrading blocks are of the dry type. For certain applications, however, it is highly desirable to lubricate the surface being finished by means of liquid such as water so that the abrasive working face will not become filled or clogged. Water has been applied by first wetting the surface being finished or by dipping the abrading block containing the abrasive sheet into water prior to use. Such methods provide only limited quantities of water.

Other devices have been employed to provide a more continuous supply of water to the surface being finished. For example, Brown (U.S. Pat. No. 2,904,940) discloses a wedge-shaped sander including a body which has openings over which a coated abrasive web is attached. As the tool is used, water is discharged through interstices in the abrasive web. Such a device, however, cannot be employed with conventional coated abrasive sheet materials because they are generally impervious. Additionally, there is little or no control of the flow of water from Brown's device because the water will continuously flow through the openings and the porous backing of the abrasive material.

Additionally, Carroll et al (U.S. Pat. No. 2,954,649) discloses a cleaning pad and holder therefor which utilizes an abrasive grid cloth held with a frame onto the surface of a sponge. Like Brown, Carroll et al require a porous abrasive sheet and have little control over the flow of the liquid from the sponge to the surface of the workpiece because there is no direct contact of the sponge with the surface being finished.

DISCLOSURE OF INVENTION

The present invention provides an abrading block which includes a means of controllably dispensing liquid onto the surface being finished during the abrading operation. The abrading block of the present invention utilizes conventional coated abrasive sheet materials, not requiring a coated abrasive sheet material having a porous backing material.

The abrading block of the invention comprises a body which has a bottom surface having an opening therein. The body is adapted to hold on the bottom surface a sheet of abrasive material having an opening therethrough, in a substantially planar position with an abrasive working face exposed. The opening through the sheet of abrasive material is aligned with the opening in the bottom surface. Of course, the sheet of abrasive material may have more than one opening, provided a sufficient number of such openings are aligned with the opening in the bottom surface of the body to permit adequate passage of liquid. An opposite surface of the body is capable of being grasped by the hand of the user. The body also contains a cavity capable of containing liquid. A conduit extends from the opening in the bottom surface to the cavity for passage of liquid from the cavity to the opening in the bottom surface. The body may include an air vent into the cavity to permit liquid to flow therefrom under gravity. A porous member is fitted into the conduit to substantially prevent the free flow of liquid from the cavity. The porous member has an exposed wiping end extending from the opening to or beyond the abrasive working face. The porous member is formed of a material which will permit the controlled passage of liquid as the exposed end is brought into contact with and passed over the surface being finished during an abrading operation in sufficient quantities to wet at least a portion of the surface with liquid.

In the preferred embodiment, the body is formed of a semi-rigid but flexible material and the porous member is a hydrophilic sponge. Because of the popularity of coated abrasive sheet materials having pressure-sensitive adhesive on the backside to facilitate attachment, the bottom surface of the body preferably includes means for facilitating attachment of the pressure-sensitive adhesive of such coated abrasive sheet materials.

BEST MODE FOR CARRYING OUT THE INVENTION

Figure 1:
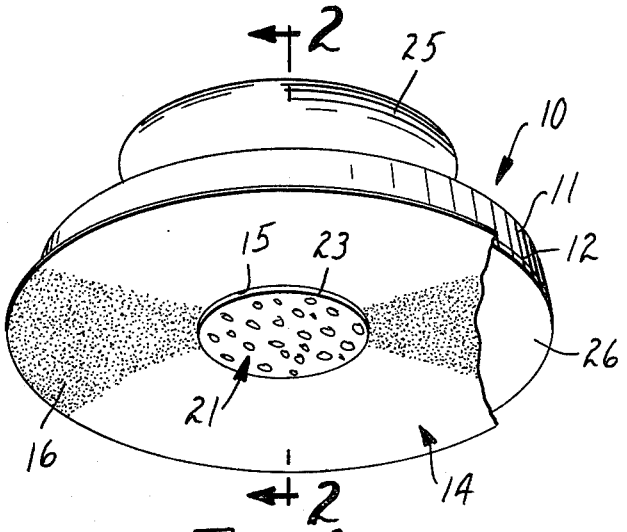
FIG. 1 is a perspective view of the abrading block of the present invention with a sheet of abrasive material mounted thereon, the sheet being partly cut away to show detail of the block.
Figure 2:
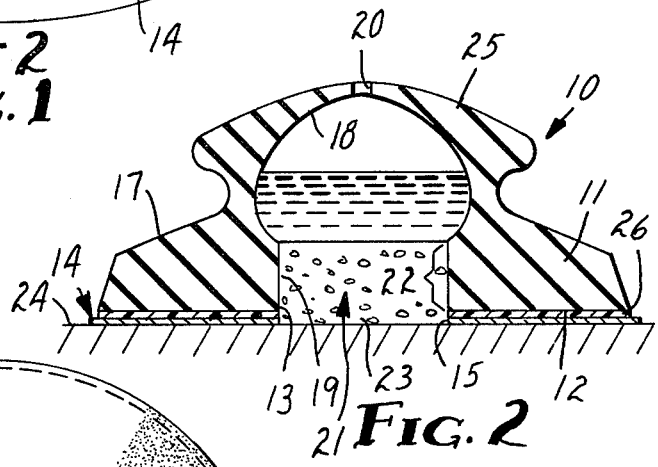
FIG. 2 is a cross sectional view of the abrading block in FIG. 1 (taken at line 2—2) in contact with a surface to be abraded.
Figure 3:
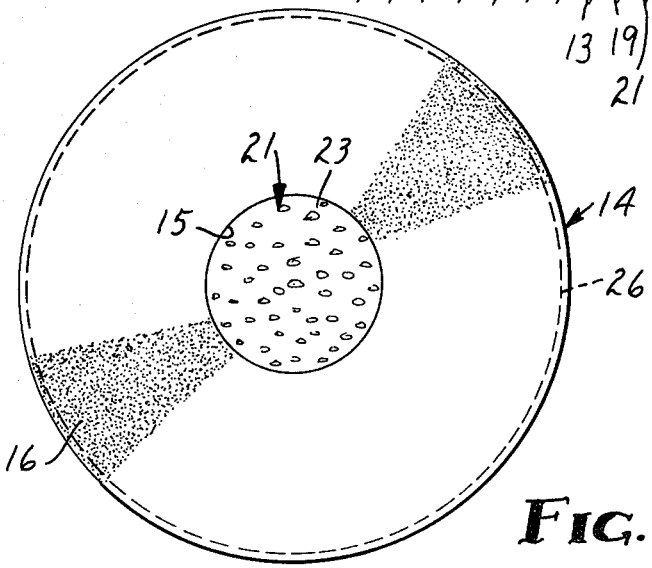
FIG. 3 is a plan view of the bottom surface of the abrading block depicted in FIG. 1.

Referring now to FIGS. 1–3, the abrading block 10 of the present invention comprises a shaped body 11 having a bottom surface 12 having an opening 13 therein. Bottom surface 12 is adapted to hold a sheet of abrasive material 14, also having an opening 15 therethrough, in a substantially planar position with an abrasive working face 16 exposed. Opening 15 of the sheet of abrasive material 14 is aligned with opening 13 in the bottom surface 12. Body 11 also includes an opposite surface 17 capable of being grasped by the hand of the user, a cavity 18 capable of containing liquid, and a conduit 19 extending from opening 13 in bottom surface 12 to cavity 18 for passage of liquid from cavity 18 through opening 13. An air vent 20 may be provided through body 11 into cavity 18 to permit liquid to flow therefrom under gravity and to permit easy filling of cavity 18 by submersion of abrading block 10 in liquid. A liquid supply line may be connected to vent 20 to provide a continuous liquid supply for use situations permitting this modification.

Abrading block 10 also includes a porous member 21 having a first portion 22 fitted into conduit 19 to substantially prevent the free flow of liquid from cavity 18 and an exposed wiping end portion 23 extending from opening 13 to abrasive working face 16. Porous member 21 is formed of a material which will permit the controlled passage of liquid as its exposed end 23 is brought into contact with and passed over surface 24 being finished during an abrading operation in a sufficient quantity to wet at least a portion of surface 24 with liquid. Body 11 is formed of any material which is sufficiently rigid to sustain the forces encountered in conventional abrading operations and prevent undue compression of porous element 21 or constriction of cavity 18 to cause the premature expulsion of liquid therefrom. Body 11, for example, may be made of wood, rigid plastic material, metal and the like. The preferred material for forming body 11 is a rigid but flexible polyurethane foam. Opposite surface 17 of body 11 may be shaped to provide a configuration, such as handle 25, which is more adapted for grasping.

The preferred shape of bottom surface 12 is an annular shape, having a central opening into which porous member 21 is fitted, for use with a correspondingly-shaped annular coated abrasive sheet. Other shapes are also contemplated, of course.

Opening 13 in bottom surface 12 may be round, as shown, or any other convenient shape such as square, triangular, oval, etc.

Porous member 21 is preferably formed of a hydrophilic sponge material which, when inserted into conduit 19, will substantially prevent the free flow of liquid but permits the passage of liquid therethrough as exposed end 23 is wiped against surface 24. Other suitable materials for formation of porous element 21 include wads of cotton batting or other fibrous materials.

Cavity 18 may be any convenient shape and may even be extremely large as compared to the size of porous member 21 or porous member 21 may completely or substantially completely fill conduit 19 and cavity 18. Conduit 19 may be relatively long or relatively short, i.e., the lower end part of cavity 18.

Porous element 21 of the preferred abrading block of the invention is preferably held into conduit 19 by frictional engagement, filling at least the bottom portion of conduit 19 from side to side to substantially prevent the free flow of liquid from cavity 18. Other means of attachment of porous element 21 are also possible such as adhesive bonding. Frictional engagement is preferred because it permits repositioning downward (i.e., outward from surface 12) of porous element 21 as its exposed end 23 wears away in use.

Because of the present popularity of coated abrasive sheet materials having a pressure-sensitive adhesive on the back side for attachment, bottom surface 12 is preferably adapted for attachment of such sheet materials. For this purpose it may be desirable to adhere or otherwise fasten to bottom surface 12 a sheet 26 of plastic material which may be more desirable for attachment of the pressure-sensitive adhesive coating of the coated abrasive sheet. Such a sheet of plastic material may be formed of a vinyl plastic or any other material to which pressure-sensitive adhesive coated material may adhere and from which it may easily be removed when the useful life of the abrasive sheet is over or when the abrasive sheet otherwise requires removal.

The liquid employed as a lubricant in abrading operations in cavity 18 preferably is water but other liquids may also be employed such as solutions of various salts which impart some improvement in the abrading operation or mixtures of water and organic liquids or organic liquids alone, depending upon the particular materials used and the particular abrading operation carried out.

The preferred abrading block of the present invention has a round opening 13 in bottom surface 12 which typically varies from about ½ inch to 2 inches in diameter. The opening should be of a sufficient size to permit an adequate amount of porous element 21 to be exposed and contact the surface being finished to provide for an adequate quantity of liquid on the surface. The most preferred embodiment has a central opening having a diameter of 1½ inch.

The preferred embodiment also has a vent hole 20, preferably about ¼ inch in diameter, to permit air to enter cavity 18, permitting release of water from cavity 18 under the force of gravity.

The abrasive sheet, of course, may contain more than one opening, provided a sufficient number of such openings are aligned with the opening in the bottom surface of the body and provided that the aligned openings in the abrasive sheet are of sufficient size to permit the porous element to extend therethrough to provide a sufficient quantity of liquid on the surface of the surface being finished.

Other modifications in the abrading pad of the abrading block of the present invention are contemplated without departing from the scope of the claims.

I claim:

1. An abrading block especially suited for manual abrading operations, said abrading block comprising (1) a body comprising:

(a) a bottom surface having an opening therein and being adapted to hold a sheet of abrasive material, having an opening therethrough, in a substantially planar position with an abrasive working face exposed and with the opening through said sheet of abrasive material aligned with the opening in said bottom surface;

(b) an opposite surface capable of being grasped by the hand of the user;

(c) a cavity capable of containing liquid; and (d) a conduit extending from said opening in said bottom surface to said cavity for passage of liquid from said cavity to said opening in said bottom surface; and (2) a porous member fitted into said conduit to substantially prevent the free flow of liquid from said cavity having an exposed wiping end extending from said opening to or beyond said abrasive working face, said porous member being formed of a material which will permit the controlled passage of liquid as said exposed end is brought into contact with and passed over a surface being finished during an abrading operation in sufficient quantity to wet at least a portion of said surface being finished with liquid.

2. The abrading block of claim 1 wherein said body is formed of a semi-rigid but flexible material.

3. The abrading block of claim 1 wherein said porous member is a sponge.

4. The abrading block of claim 1 wherein said sheet of abrasive material is a coated abrasive sheet having pressure-sensitive adhesive on a surface opposite said abrasive working face to facilitate attachment thereof to said bottom surface and said bottom surface includes means for facilitating attachment of the pressure-sensitive adhesive surface of said coated abrasive sheet.

5. The abrading block of claim 1 wherein said body includes an air vent from said opposite surface into said cavity to permit liquid to flow.

* * * * *